US009198267B2

(12) United States Patent
Ishihara et al.

(10) Patent No.: US 9,198,267 B2
(45) Date of Patent: Nov. 24, 2015

(54) DEUTERIUM LAMP POWER SUPPLY CIRCUIT

(71) Applicant: SHIMADZU CORPORATION, Kyoto-shi, Kyoto (JP)

(72) Inventors: Yugo Ishihara, Muko (JP); Hajime Bungo, Muko (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 14/063,071

(22) Filed: Oct. 25, 2013

(65) Prior Publication Data

US 2014/0117870 A1 May 1, 2014

(30) Foreign Application Priority Data

Oct. 26, 2012 (JP) ..... 2012-236929

(51) Int. Cl.
*H05B 41/30* (2006.01)
*H05B 41/14* (2006.01)
*H05B 41/34* (2006.01)

(52) U.S. Cl.
CPC ..... *H05B 41/14* (2013.01); *H05B 41/30* (2013.01); *H05B 41/34* (2013.01)

(58) Field of Classification Search
CPC ..... H01J 61/68; H01J 13/02; H01J 17/40; H01J 17/49; H05B 41/04; H05B 41/24; H05B 41/382; H05B 41/232; H05B 41/34; H01H 33/596
USPC ..... 315/56, 94, 105–108, 291, 294, 297, 315/307–308
See application file for complete search history.

(56) References Cited

U.S. PATENT DOCUMENTS

| | | | | |
|---|---|---|---|---|
| 3,196,312 | A * | 7/1965 | Marrison | 315/171 |
| 4,740,858 | A * | 4/1988 | Yamaguchi et al. | 361/4 |
| 4,802,739 | A * | 2/1989 | Iwamoto | 345/87 |
| 7,242,154 | B2 * | 7/2007 | Rudolph | 315/291 |
| 8,193,740 | B2 * | 6/2012 | Ueno et al. | 315/307 |
| 8,314,557 | B2 * | 11/2012 | Ito et al. | 315/56 |

FOREIGN PATENT DOCUMENTS

| | | |
|---|---|---|
| JP | 62-14698 | 1/1987 |
| JP | 06-085364 | 3/1994 |
| JP | 07-211294 | 8/1995 |
| JP | 9-210780 A | 8/1997 |

* cited by examiner

*Primary Examiner* — Vibol Tan
(74) *Attorney, Agent, or Firm* — Sughrue Mion, PLLC

(57) ABSTRACT

Provided is a deuterium lamp power supply circuit capable of preventing the application of a high switch-to-ground voltage to a switch when applying a voltage between a positive electrode and negative electrode to light a deuterium lamp. The power supply circuit includes a capacitor for applying a voltage between the positive electrode and the negative electrode, with one terminal of the capacitor being connected to the positive electrode; a power supply, installed between the capacitor and the negative electrode, for charging the capacitor; and a two-terminal switch connected in parallel to the power supply. The switch is placed at a location close to ground, and thus a high switch-to-ground voltage is not applied to the switch.

8 Claims, 2 Drawing Sheets

DEUTERIUM LAMP POWER SUPPLY CIRCUIT

TECHNICAL FIELD

The present invention relates to a deuterium lamp power supply circuit used to light a deuterium lamp equipped with an auxiliary electrode.

BACKGROUND ART

A spectrophotometer used in an analyzer (such as a liquid chromatograph) extracts only a desired wavelength component from a spectrum of light emitted from a light source, illuminates a sample component with the extracted light, detects transmitted light, and thereby measures absorbance. A deuterium lamp, a tungsten halogen lamp, or the like is used as the light source. The deuterium lamp mainly emits light in the ultraviolet region, while the tungsten halogen lamp emits light in the visible region.

To light a deuterium lamp, a negative electrode is first heated by a heater or the like to emit thermoelectrons. In this state, a voltage (trigger voltage) is applied between the positive electrode and negative electrode to initiate an electric discharge of deuterium gas existing between the positive electrode and negative electrode (initial discharge). Furthermore, when the initial discharge grows while the trigger voltage is being applied, the impedance between the positive electrode and negative electrode begins to decrease, triggering a main discharge.

A constant-current power supply that operates when a load impedance is at or below a predetermined threshold level is connected between the positive electrode and negative electrode. When the impedance between the positive electrode and negative electrode falls to the threshold as a result of the main discharge, the constant-current power supply comes into operation to cause a predetermined current to flow, maintaining the main discharge and turning on the lamp (see Patent Document 1).

FIG. 3 shows a typical power supply circuit used to light the deuterium lamp. The power supply circuit 20*a* is roughly divided into three parts: a heater power supply 21, a trigger power supply 22*a*, and a constant-current power supply 23. The heater power supply 21 is used to supply an electric current to the negative electrode 26 and thereby heat the negative electrode 26, while the trigger power supply 22*a* is used to produce an initial discharge. The constant-current power supply 23 is used to maintain a main discharge after a transition from the initial discharge. Normally, one end of the deuterium lamp 24*a* on the side of the negative electrode 26 is grounded.

To light the deuterium lamp 24*a*, an electric current is first supplied to the negative electrode 26 (filament) from the heater power supply 21 (a variable voltage source) to heat the negative electrode (filament) 26 and thereby cause the filament 26 to emit thermoelectrons. In the trigger power supply 22*a*, a three-terminal switch S21 is set to the side of a constant-voltage power supply E21, and a capacitor C21 is charged until its voltage becomes equal to that of the constant-voltage power supply E21 (normally on the order of 400 to 600 V).

Next, the switch S21 is set to the side of the positive electrode 25 of the deuterium lamp 24*a* and the voltage of the capacitor C21 is applied between the positive electrode 25 and negative electrode 26 via a resistor R21. The applied voltage causes an initial discharge, which further grows into a main discharge. As a result of the main discharge, the impedance between the positive electrode 25 and negative electrode 26 falls, causing a constant current (around 300 mA) to flow from the constant-current power supply 23, thereby maintaining the main discharge and turning on the lamp.

Various switches are available including a mechanical switch (mechanical relay) and a semiconductor switch, but in the circuit configuration shown in FIG. 3, it is difficult to use a semiconductor switch, because a high switch-to-ground voltage on the order of 400 to 600 V is applied to the switch S21 placed between the positive electrode 25 and capacitor C21. Under such a condition, it is necessary to use a mechanical switch with a superior resistance to high voltages.

The discharge characteristics of the deuterium lamp deteriorate with age due to wear and tear of the electrodes and consumption of deuterium gas. Therefore, even if a constant trigger voltage is applied between the positive electrode and negative electrode, the initial discharge may not be able to grow in the previously described manner.

Thus, to ensure that an electric discharge will more reliably start, a deuterium lamp equipped with an auxiliary electrode between the positive electrode and negative electrode has been developed. In this deuterium lamp, the distance between the auxiliary electrode and negative electrode is configured to be shorter than the distance between the positive electrode and negative electrode. Consequently, when a voltage is applied between the auxiliary electrode and negative electrode, an initial discharge is produced relatively easily, and if a voltage is applied between the positive electrode and negative electrode at the same time, the initial discharge between the auxiliary electrode and negative electrode will serve as a pilot light in causing the initial discharge between the positive electrode and negative electrode to grow easily into a main discharge.

FIG. 4 shows a typical power supply circuit used to light a deuterium lamp provided with an auxiliary electrode. The deuterium lamp 24*b* differs from that of FIG. 3 in that the deuterium lamp 24*b* is equipped with an auxiliary electrode 27 as well as with a capacitor C22, resistor R22, and switch S22 used to apply a voltage between the auxiliary electrode 27 and negative electrode 26.

To turn on the deuterium lamp 24*b*, not only the capacitor C21, but also the capacitor C22 are charged in advance by the constant-voltage power supply E21 via the switch S22. Then, by simultaneously setting the switches S21 and S22 to the side of the positive electrode 25 of the deuterium lamp 24*b*, the voltage of the capacitor C22 is applied between the auxiliary electrode 27 and negative electrode 26 via the resistor R22 and at the same time the voltage of the capacitor C21 is applied between the positive electrode 25 and negative electrode 26 via the resistor R21. Consequently, an initial discharge occurs due to the application of the voltage between the auxiliary electrode 27 and negative electrode 26 and grows into a main discharge due to the simultaneous application of the voltage between the positive electrode 25 and negative electrode 26. In this way, the deuterium lamp 24*b* is turned on.

As described so far, the voltage needed for the deuterium lamp to begin electric discharge is applied via a capacitor. By the application of the voltage, the capacitor discharges and the capacitor voltage falls sharply. Consequently, the voltage needed for the initial discharge to grow is applied for a short period of time; the time constant of a typical circuit configuration for the electric discharge is only a few μsec to a few tens of μsec. Therefore, it is important to time the voltage application between the positive electrode and negative electrode with the voltage application between the auxiliary electrode and negative electrode.

In the configuration of the power supply circuit of FIG. 4, in order to time the applications of the two voltages with each other, it is important to synchronize the two switches S21 and S22 with each other.

BACKGROUND ART DOCUMENT

Patent Document

[Patent Document 1] JP-A 9-210780

DISCLOSURE OF THE INVENTION

Problems to be Solved by the Invention

As described earlier, the conventional power supply circuit uses a mechanical switch due to limitations on withstand voltage. However, the mechanical switch, which does the switching by a mechanical action, may cause chatter at the time of switching. Therefore, there are quite a few cases in which the voltage application is interrupted before producing a main discharge and the deuterium lamp fails to turn on even though an initial discharge is started.

Furthermore, in the case of a deuterium lamp equipped with an auxiliary electrode, it is difficult to synchronize the switching (i.e., mechanical actions) between the two mechanical switches when turning on the deuterium lamp, and there tends to be a timing gap between the voltage application between the positive electrode and negative electrode and the voltage application between the auxiliary electrode and negative electrode. Besides, if the voltage application is interrupted by chatter, it becomes difficult to match the timing as well, spoiling the advantages of installing the auxiliary electrode.

The present invention has been made in view of the aforementioned problems and has an object to provide a deuterium lamp power supply circuit which prevents a high switch-to-ground voltage from being applied to a switch and thereby allows the choice of a chatter-free switch from a wider variety of switches.

Furthermore, for a deuterium lamp equipped with an auxiliary electrode, the present invention provides a power supply circuit which is capable of minimizing a timing gap between the voltage application between the positive electrode and negative electrode and the voltage application between the auxiliary electrode and negative electrode in addition to solving the aforementioned problems.

Means for Solving the Problems

To solve the aforementioned problems, the present invention provides a deuterium lamp power supply circuit for lighting a deuterium lamp equipped with a positive electrode and a negative electrode, including:

a) a capacitor for applying a voltage between the positive electrode and the negative electrode, with one terminal of the capacitor being connected to the positive electrode;

b) a power supply, installed between the capacitor and the negative electrode, for charging the capacitor; and c) a two-terminal switch connected in parallel to the power supply.

With this configuration, the switch is placed between the capacitor and negative electrode (i.e., on the side closer to ground). This prevents a high switch-to-ground voltage from being applied to the switch and thereby allows the use of a semiconductor switch free of chatter. Furthermore, since the switch needs to have only two terminals, the circuit configuration can be simplified as compared to the conventional circuit in which a three-terminal switch is used.

The deuterium lamp power supply circuit may further include:

d) a resistor placed between the positive electrode and the capacitor; and e) a diode whose cathode is connected to a terminal of the capacitor on the side of the resistor and whose anode is connected to the negative electrode.

To solve the aforementioned problems, another aspect of the present invention provides a deuterium lamp power supply circuit for lighting a deuterium lamp equipped with a positive electrode, a negative electrode, and an auxiliary electrode including:

a) a first capacitor for applying a voltage between the positive electrode and the negative electrode, with one terminal of the first capacitor being connected to the positive electrode;

b) a second capacitor for applying a voltage between the auxiliary electrode and the negative electrode, with one terminal of the second capacitor being connected to the auxiliary electrode;

c) a power supply, installed between the first and second capacitors and the negative electrode, for charging the first capacitor and the second capacitor; and d) a two-terminal switch connected in parallel to the power supply.

With this configuration, the deuterium lamp equipped with the auxiliary electrode can be turned on by simply operating a single switch to apply a voltage between the positive electrode and negative electrode by the first capacitor as well as a voltage between the auxiliary electrode and negative electrode by the second capacitor.

Of course, a semiconductor switch may also be used in this configuration.

The deuterium lamp power supply circuit may further include:

e) a first resistor placed between the positive electrode and the first capacitor;

f) a second resistor placed between the auxiliary electrode and the second capacitor;

g) a first diode whose cathode is connected to a terminal of the first capacitor on the side of the first resistor and whose anode is connected to the negative electrode; and h) a second diode whose cathode is connected to a terminal of the second capacitor on the side of the second resistor and whose anode is connected to the negative electrode.

Effects of the Invention

With the deuterium lamp power supply circuit according to the present invention, the requirements of a switch in terms of the withstand voltage performance are relaxed greatly, which widens the scope of choices of the switch. This makes it possible, for example, to use a semiconductor switch and prevent the chatter which occurs in the switching operation if conventional mechanical switches are used.

Furthermore, in turning on the deuterium lamp equipped with the auxiliary electrode, in addition to the aforementioned advantage, the present invention provides the following advantage. Since only a single switch is used, there is no timing gap between the voltage application between the positive electrode and negative electrode and the voltage application between the auxiliary electrode and negative electrode.

Therefore, an initial discharge can be made to grow into a main discharge, thereby turning on the deuterium lamp more reliably than is conventionally the case.

BEST MODES FOR CARRYING OUT THE INVENTION

A deuterium lamp power supply circuit according to the present invention will be described hereinafter in detail with reference to the accompanying drawings.

FIRST EMBODIMENT

Figure 1:
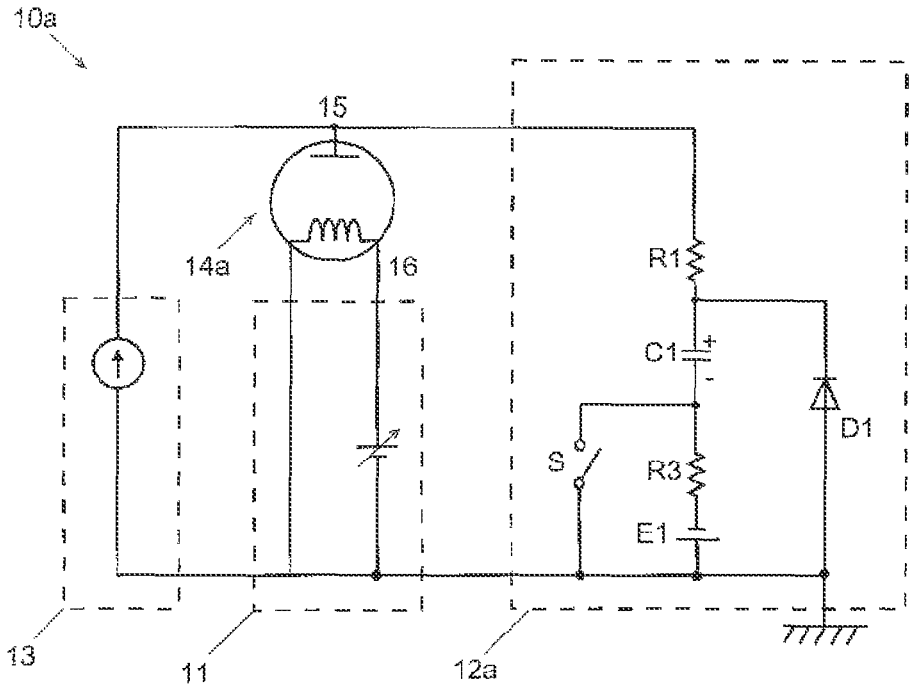
FIG. 1 is a diagram showing a deuterium lamp power supply circuit according to the present invention.
Figure 3:
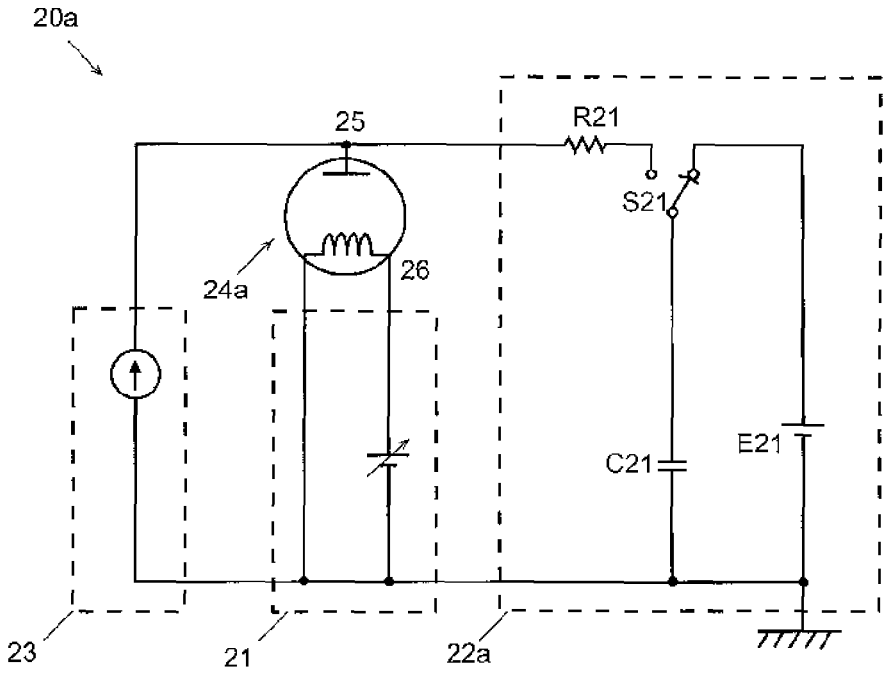
Fig. 3 PRIOR ART
FIG. 3 is a diagram showing an example of a conventional deuterium lamp power supply circuit.
Figure 4:
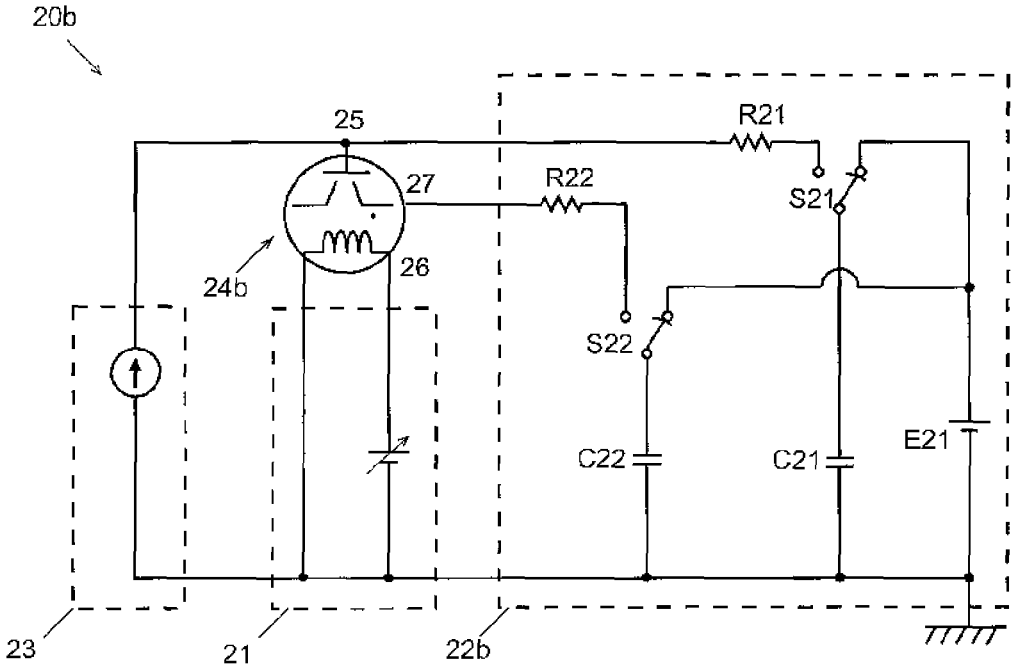
Fig. 4 PRIOR ART
FIG. 4 is a diagram showing an example of a conventional deuterium lamp power supply circuit used for a deuterium lamp equipped with an auxiliary electrode.

FIG. 1 is a configuration diagram of the principal part of a power supply circuit 10*a*, according to a first embodiment of the present invention used for a deuterium lamp equipped with a positive electrode and negative electrode. A basic configuration is similar to that of a conventional power supply circuit 20*a* (FIG. 3). The power supply circuit 10*a* includes a heater power supply 11, a trigger power supply 12*a*, and a constant-current power supply 13. The heater power supply 11 is used to supply electric current to a negative electrode 16, thereby heating the negative electrode 16, while the trigger power supply 12*a* is used to produce an initial discharge. The constant-current power supply 13 is used to maintain the electric discharge.

A characteristic part of the present invention is a configuration of the trigger power supply 12*a*. The trigger power supply 12*a* includes resistors R1 and R3, a capacitor C1, a switch S, a diode D1, and a constant-voltage power supply E1. Here, a positive terminal of E1 is connected to ground. The capacitor C1 is used to apply a voltage between a positive electrode 15 and negative electrode 16. The resistor R1 is used to compensate for negative resistance of the deuterium lamp 14*a*. The resistor R3 is used to prevent rush current from E1 to C1, provide the time constant for the charging of C1, and prevent the two ends of E1 from short-circuiting when the switch S is closed. The diode D1, whose cathode is connected to a terminal of C1 on the side of R1 and whose anode is connected to the negative electrode 16, is used to enable charging from E1 to C1 and prevent reverse flow of electric current. The switch S is a two-terminal switch for the switching between charging and discharging of C1.

To turn on the lamp, first, an electric current is supplied to the negative electrode 16 from the heater power supply 11. Meanwhile, with the switch S turned off, the trigger power supply 12*a* charges C1 via D1 until a potential difference across C1 becomes equal to E1.

The negative electrode 16 is heated to a predetermined temperature in approximately a minimum of 20 sec. to emit thermoelectrons. At this timing, the switch S is turned on to bypass E1 (and a portion in series with R3) through a shortcut. Consequently, the terminal of C1 on the side of the switch S is connected to the negative electrode 16, the opposite terminal is connected to the positive electrode 15 via R1, and the voltage across C1 is applied between the positive electrode 15 and negative electrode 16. In so doing, a backflow prevention function of D1 prevents the positive terminal and negative terminal of C1 from short-circuiting.

The applied voltage causes an initial discharge between the positive electrode 15 and negative electrode 16, which grows into a main discharge. Meanwhile, the impedance between the positive electrode 15 and negative electrode 16 decreases, allowing an electric current from the constant-current power supply 13 to flow between the positive electrode 15 and negative electrode 16. This current maintains the main discharge and thereby lights the deuterium lamp 14*a*.

Thus, the deuterium lamp power supply circuit 10*a* according to the first embodiment of the present invention turns on the deuterium lamp 14*a* by operating the switch S, but unlike a conventional circuit configuration (FIG. 3), the switch S is placed at a location close to a ground. This prevents a high switch-to-ground voltage from being applied to the switch S and thereby allows the use of a semiconductor switch free of chatter.

By an actual experiment, it was confirmed that a deuterium lamp can be turned on by using a semiconductor switch under the following conditions.

A commercially available product was used as the deuterium lamp 14*a*, and a variable voltage source was used as the heater power supply 11 to allow the temperature of the negative electrode 16 to be adjusted. A constant-voltage power source capable of producing an output voltage on the order of 400 to 600 V was used as E1 of the trigger power supply 12*a*, and a power source capable of producing an output current on the order of 200 to 300 mA was used as the constant-current power supply 13. The value of R1 was 100Ω. A capacitor with a withstanding voltage of 1,000V was used as C1 so that it could withstand the output voltage of E1. A general-purpose semiconductor switch (FET) with a switching time of around 0.1 μsec was used as the switch S, and a diode with a withstand voltage of 1,000V or above was used as D1.

SECOND EMBODIMENT

Figure 2:
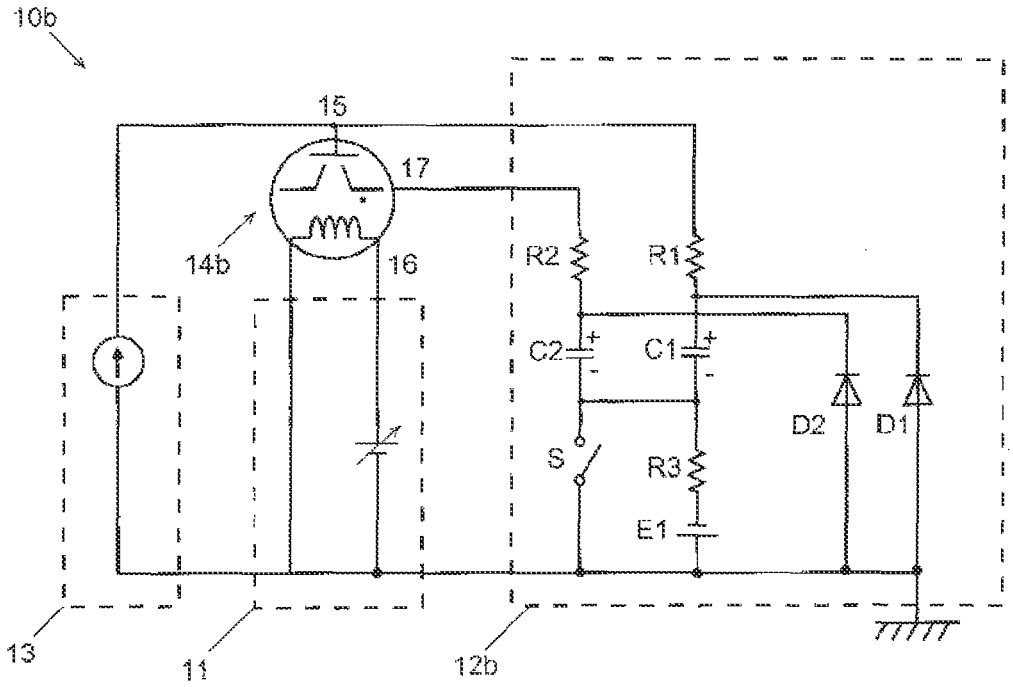
FIG. 2 is a diagram showing a deuterium lamp power supply circuit according to the present invention used for a deuterium lamp equipped with an auxiliary electrode.

FIG. 2 is a configuration diagram of the principal part of a power supply circuit 10*b* used for a deuterium lamp equipped with a positive electrode, negative electrode, and auxiliary electrode, according to a second embodiment of the present invention. Compared with the first embodiment (FIG. 1), the deuterium lamp 14*b* is equipped with an auxiliary electrode 17, and furthermore, a resistor R2, capacitor C2, and diode D2 are added to a circuit configuration to apply a voltage between the auxiliary electrode 17 and negative electrode 16.

In the circuit of FIG. 2, while the negative electrode 16 is being heated by the heater power supply 11, C1 and C2 are charged via D1 and D2, respectively, with the switch S turned off until a potential difference across C1 as well as a potential difference across C2 become equal to the value of E1.

Next, the switch S is turned on so as to connect the terminals of C1 and C2 on the side of the switch S to the negative electrode 16, and also to connect the opposite terminals to the positive electrode 15 and auxiliary electrode 17 via R1 and R2, respectively. As a result, the voltage across C1 is applied between the positive electrode 15 and negative electrode 16, while the voltage across C2 is applied between the auxiliary electrode 17 and negative electrode 16. In so doing, the backflow prevention functions of D1 and D2 prevent the positive terminals and negative terminals of C1 and C2 from short-circuiting.

The voltage applied between the auxiliary electrode 17 and negative electrode 16 causes an initial discharge. Meanwhile, the impedance between the positive electrode 15 and negative electrode 16 is decreased by the voltage applied between the positive electrode 15 and negative electrode 16, causing the initial discharge to grow into a main discharge. Consequently, an electric current from the constant-current power supply 13 flows between the positive electrode 15 and negative electrode 16, maintaining the main discharge and thereby lighting the deuterium lamp 14*b*.

Thus, in the deuterium lamp power supply circuit 10*b* according to the second embodiment of the present invention, both the application of the voltage between the positive electrode and negative electrode and the application of the voltage between the auxiliary electrode and negative electrode can be initiated by simply operating the switch S, so that there is no timing gap between the voltage applications.

In the actual circuit, the constants for various devices, power supply settings, and other settings were the same as in the first embodiment, and R2, C2, and D2 were the same as R1, C1, and D1, respectively. With this circuit configuration, it was confirmed that the deuterium lamp equipped with a commercially available auxiliary electrode could be turned on.

The deuterium lamp power supply circuit according to each of the first and second embodiments of the present invention also has the advantage that it only needs a two-terminal switch and allows the circuit configuration to be simpler than the conventional one in which a three-terminal switch is used.

Note that the values of the constants for R1, R2, C1, C2, and the like used in the present embodiments are exemplary and may be selected appropriately.

EXPLANATION OF NUMERALS

10*a*, 10*b*, 20*a*, 20*b* . . . Power Supply Circuit
11, 21 . . . Heater Power Supply
12*a*, 12*b*, 22*a*, 22*b* . . . Trigger Power Supply
13, 23 . . . Constant-Current Power Supply
14*a*, 14*b*, 24*a*, 24*b* . . . Deuterium Lamp
15, 25 . . . Positive Electrode
16, 26 . . . Negative Electrode
17, 27 . . . Auxiliary Electrode
S, S21, S22 . . . Switch
E1, E21 . . . Constant-Voltage Power Supply

The invention claimed is:

1. A deuterium lamp power supply circuit comprising:

a) a capacitor for applying a voltage between a positive electrode of a deuterium lamp and a negative electrode of the deuterium lamp, with one terminal of the capacitor being connected to the positive electrode;

b) a power supply, installed between the capacitor and the negative electrode, for charging the capacitor; and c) a two-terminal switch connected in parallel to the power supply.

2. The deuterium lamp power supply circuit according to claim 1, further comprising:

d) a resistor placed between the positive electrode and the capacitor; and e) a diode whose cathode is connected to a terminal of the capacitor on the side of the resistor and whose anode is connected to the negative electrode.

3. A deuterium lamp power supply circuit for lighting a deuterium lamp equipped with a positive electrode, a negative electrode, and an auxiliary electrode comprising:

a) a first capacitor for applying a voltage between the positive electrode and the negative electrode, with one terminal of the first capacitor being connected to the positive electrode;

b) a second capacitor for applying a voltage between the auxiliary electrode and the negative electrode, with one terminal of the second capacitor being connected to the auxiliary electrode;

c) a power supply, installed between the first and second capacitors and the negative electrode, for charging the first capacitor and the second capacitor; and d) a two-terminal switch connected in parallel to the power supply.

4. The deuterium lamp power supply circuit according to claim 3, further comprising:

e) a first resistor placed between the positive electrode and the first capacitor;

f) a second resistor placed between the auxiliary electrode and the second capacitor;

g) a first diode whose cathode is connected to a terminal of the first capacitor on the side of the first resistor and whose anode is connected to the negative electrode; and h) a second diode whose cathode is connected to a terminal of the second capacitor on the side of the second resistor and whose anode is connected to the negative electrode.

5. The deuterium lamp power supply circuit according to claim 1, wherein the two-terminal switch is a semiconductor switch.

6. The deuterium lamp power supply circuit according to claim 2, wherein the two-terminal switch is a semiconductor switch.

7. The deuterium lamp power supply circuit according to claim 3, wherein the two-terminal switch is a semiconductor switch.

8. The deuterium lamp power supply circuit according to claim 4, wherein the two-terminal switch is a semiconductor switch.

* * * * *